United States Patent [19]

Gorring et al.

[11] 4,292,166

[45] Sep. 29, 1981

[54] CATALYTIC PROCESS FOR MANUFACTURE OF LUBRICATING OILS

[75] Inventors: Robert L. Gorring, Washington Crossing; Rene B. La Pierre, Morrisville, both of Pa.

[73] Assignee: Mobil Oil Corporation, New York, N.Y.

[21] Appl. No.: 166,661

[22] Filed: Jul. 7, 1980

[51] Int. Cl.[3] ..... C10G 45/12; C10G 48/18; C10G 65/02

[52] U.S. Cl. ..... 208/59; 208/254 H; 208/97

[58] Field of Search ..... 208/59, 18, DIG. 2

[56] References Cited

U.S. PATENT DOCUMENTS

| | | | |
|---|---|---|---|
| 3,520,796 | 7/1970 | Murphy et al. | 208/264 X |
| 3,658,689 | 4/1972 | Steinmetz et al. | 208/18 X |
| 3,755,145 | 8/1973 | Orkin | 208/18 X |
| 3,894,938 | 7/1975 | Gorring et al. | 208/97 |
| 3,956,102 | 5/1976 | Chen et al. | 208/93 |
| 4,137,148 | 1/1979 | Gillespie et al. | 208/87 |
| 4,162,962 | 7/1979 | Stangeland et al. | 208/58 |

*Primary Examiner*—Delbert E. Gantz
*Assistant Examiner*—G. E. Schmitkons
*Attorney, Agent, or Firm*—C. A. Huggett; M. G. Gilman; V. J. Frilette

[57] ABSTRACT

A method is disclosed for converting an asphalt-free heavy hydrocarbon oil to high V.I. low pour point lube base stock and naphtha. The heavy oil is first catalytically dewaxed with a catalyst such as Ni-ZSM-5 and the dewaxed oil is then hydrocracked, or hydroconverted with a large pore zeolite catalyst such as dealuminized Y or ZSM-20 associated with palladium. The V.I. is controlled by the severity of the hydroconversion step.

22 Claims, No Drawings

CATALYTIC PROCESS FOR MANUFACTURE OF LUBRICATING OILS

BACKGROUND OF THE INVENTION

1. Field of the Invention

This invention is concerned with a process for the manufacture of lubricating oils. In particular, it is concerned with a particular combination and sequence of catalytic unit processes whereby a hydrocracked lube oil having a low pour point and a high viscosity index is produced.

2. Prior Art

Refining suitable petroleum crude oils to obtain a variety of lubricating oils which function effectively in diverse environments has become a highly developed and complex art.

In general, the basic notion in conventional lubricant refining is that a suitable crude oil, as shown by experience or by assay, contains a quantity of lubricant stock having a predetermined set of properties such as, for example, appropriate viscosity, oxidation stability, and maintenance of fluidity at low temperatures. The process of refining to isolate that lubricant stock consists of a set of subtractive unit operations which removes the unwanted components. The most important of these unit operations include distillation, solvent refining, and dewaxing, which basically are physical separation processes in the sense that recombination of all the separated fractions would reconstitute the crude oil.

Unfortunately, crude oils suitable for the manufacture of lubes by conventional processing are becoming less available due to exhaustion of reserves, and the reliability of a steady, adequate supply from a known source is a matter of concern due to political instability.

The desirability of upgrading a crude fraction normally considered unsuitable for lubricant manufacture to one from which good yields of lubes can be obtained has long been recognized. The so-called "hydrocracking process" has been proposed to accomplish such upgrading. In this process, a suitable fraction of a poor grade crude, such as a California crude, is catalytically reacted with hydrogen under pressure. The process is complex in that some of the oil is reduced in molecular weight and made unsuitable for lubes, but concurrently a substantial fraction of the polynuclear aromatics is hydrogenated and cracked to form naphthenes and isoparaffins. The catalyst and the process conditions usually are selected to provide an optimal conversion of the polynuclear aromatic content of the stock, since it is primarily this component that degrades the viscosity index of the stock.

The hydrocracking process for increasing the availability of lube oils has an attractive feature that is not immediately apparent. Generally, the composition and properties of hydrocracked stocks are not particularly affected by the source and nature of the crude, i.e. they tend to be much more alike than lube fractions prepared from different crudes by conventional means. Thus, the hydrocracking process promises to free the refiner from dependence on a particular crude, with all of the advantages that this freedom implies.

Hydrocracked lubricating oils generally have an unacceptably high pour point and require dewaxing. Solvent dewaxing is a well-known and effective process but expensive. More recently catalytic methods for dewaxing have been proposed. U.S. Pat. No. Re. 28,398 to Chen et al, herein incorporated by reference, describes a catalytic dewaxing process wherein a particular crystalline zeolite is used.

Hydrofinishing processes have been successful in replacing clay decolorization. In such processes, color bodies and other undesirable sulfur and nitrogen compounds are chemically transformed in the presence of hydrogen with essentially 100 percent recovery of the charge oil as finished lube stock. A modification of the hydrofinishing process has been proposed in U.S. Pat. No. 4,162,962 to Stangeland, and the process adapted to hydrogenating unstable hydrocracked lube oils. The entire content of this patent is incorporated herein by reference.

In general, whether conventional or catalytic processes or combinations of these are used or are proposed to prepare high viscosity index (hereinafter denoted "high V.I.") lubes of low pour point, the process scheme usually contemplated is to remove or to convert to isoparaffins the undesirable polynuclear aromatic hydrocarbons prior to separation of the waxes. U.S. Pat. No. 3,755,145 to Orkin describes a process for catalytic hydrocracking of waxy raw distillates and residual stocks with a catalyst mixture comprising a hydrogenation component and at least two separate acidic cracking catalysts, one of which is a crystalline aluminosilicate of the ZSM-5 type. In this process it appears that dewaxing and conversion of polynuclear aromatics occurs simultaneously.

BRIEF SUMMARY OF THE INVENTION

This invention provides a process for the catalytic conversion of a hydrocarbon feedstock selected from the group consisting of vacuum gas oils, deasphalted oils, and mixtures thereof boiling above 650° F. (343° C.) to form high V.I. low pour point lubricating oils in unusually high yield and low pour point volatile hydrocarbon liquids. The process comprises catalytically dewaxing the feedstock in a first reaction zone with a zeolite catalyst having a Constraint Index from 1 to 12, all as more fully described hereinbelow, followed by hydrocracking of the dewaxed feed in a second reaction zone with a hydrocracking catalyst comprising a hydrogenation component and a cracking catalyst of the large-pore type. The unusually high yield provided by this process is believed to result from catalytically dewaxing the feedstock prior to hydrocracking rather than after or during hydrocracking, as taught in the prior art. While not wishing to be bound by theory, it is believed that, in the combination of catalytic dewaxing and hydrocracking, dewaxing first to a lower-than-specification pour point on the whole enhances conservation of desirable high VI isoparaffins, a large portion of which is produced in the hydrocracking step.

Whereas the foregoing description represents a description of this invention in its broadest aspect, we have found that a particularly advantageous embodiment of the invention is provided when the hydrocracking catalyst comprises a large pore zeolite having a silica to alumina ratio of at least 6, said zeolite being selected from the group consisting of dealuminized zeolite Y and ZSM-20, associated with a platinum group metal hydrogenation component as more fully described hereinbelow. This particular hydrocracking catalyst will hereinafter be referred to as a "hydroconversion" catalyst for reasons which will become apparent.

Applicants believe that the foregoing hydroconversion catalyst is novel and that it possesses unusual properties. The hydroconversion catalyst, its preparation, and its properties are described in copending U.S. patent applications Ser. Nos. 005,066 filed Jan. 22, 1979 and 092,918 filed Nov. 9, 1979, the entire contents of these applications being incorporated herein by reference. Briefly, the described hydroconversion catalyst is effective for hydrogenating aromatic hydrocarbons at low pressure in the presence of organic nitrogen and sulfur compounds, and thus simultaneously performs a hydrocracking function, i.e. saturates and cracks polynuclear aromatics; and a hydrotreating function, i.e. reduces the nitrogen and the sulfur content of the product.

With certain feeds that contain high levels of deleterious nitrogen compounds, it is contemplated to interpose a conventional hydrotreating step between the catalytic dewaxing and the hydrocracking step to reduce the nitrogen content of the dewaxed feed, as more fully described hereinbelow.

It is an object of the present invention to provide an improved process for the manufacture of hydrocracked lubricating oils. It is a further object to provide a method for manufacturing hydrocracked lubricating oils having a low pour point and a high viscosity index in high yield. It is a further object of this invention to provide a process for manufacturing hydrocracked lubricating oils that eliminates the need for costly solvent treatment steps. These and other objects will become evident to one skilled in the art on reading this entire specification including the appended claims.

DETAILED DESCRIPTION AND PREFERRED EMBODIMENTS

The feedstock for the process of this invention may be any substantially asphalt-free hydrocarbon oil boiling above 650° F. (343° C.). The preferred feedstock is derived from a crude petroleum oil, and is selected from the group consisting of vacuum gas oils, deasphalted oils, and mixtures thereof. In general, such preferred feedstocks will have a pour point greater than about +15° F., (−9° C.) and sometimes substantially greater than about +25° F. (−4° C.).

In the method of the present invention, the feedstock described above is catalytically dewaxed in the presence of hydrogen with a catalyst consisting of a hydrogenation metal and zeolite ZSM-5 or other aluminosilicate zeolite having a silica to alumina ratio above 12 and a Constraint Index of 1–12. A description of such catalyst and of the Constraint Index and its measurement are given in Columns 3 through Column 9 of U.S. Pat. No. 4,137,148 issued Jan. 30, 1979, which description is herein incorporated by reference. The preferred dewaxing catalyst for purposes of this invention contains as the zeolite component ZSM-5 or ZSM-11. The catalyst preferably contains a hydrogenation component such as nickel or palladium, and advantageously is steamed prior to use. Preferred catalysts are exemplified by Pd-HZSM-5 and steamed Ni-ZSM-5. Contemplated as equivalent to the described zeolite are those crystalline siliceous structures which contain a vanishingly small content of alumina or other metal substituted for alumina but otherwise topologically similar, i.e., exhibiting substantially the same X-ray diffraction pattern and sorption properties as the described zeolite. Such crystalline siliceous structures are described in U.S. Pat. No. Re. 29,948 to Dwyer et al, incorporated herein by reference.

The dewaxing step in the present invention is conducted under pressure and in the presence of hydrogen under the conditions set forth in Table I.

TABLE I

DEWAXING CONDITIONS

| Conditions | LHSV | Pressure | Temperature | $H_2$ Circulation |
|---|---|---|---|---|
| Broad | 0.1–10 | 0–2000 psig | 450°–850° F. (232°–454° C.) | 0–10,000 SCF/bbl |
| Preferred | 0.5–2.0 | 500–1750 psig | 550°–750° F. (288°–399° C.) | 2000–5000 SCF/bbl |

In general, the pour point of the feed to the catalytic dewaxing zone will be substantially higher than +25° F. (−4° C.), such as, for example, +75° F. (+24° C.). In all cases, for purposes of this invention, the dewaxing conditions are selected to produce a +650° F. (+343° C.) hydrocarbon product having a pour point less than about +15° F. (−9° C.). The actual target pour point for the dewaxing step is determined by the severity chosen for the hydrocracking or hydroconversion step since this step increases the pour point of the lube oil base stock recovered, i.e. the +650° F. (+343° C.) fraction of the ultimate product, which is contemplated to have a pour point not higher than about +25° F. (−4° C.).

The dewaxed feedstock prepared in accordance with the description given above will contain a minor fraction, up to 40 wt.% for example, of light products boiling below +650° F. (+343° C.). These light products may be separated to any extent desired before the hydrocracking or hydroconversion step, or the total dewaxed hydrocarbon effluent may be converted in a cascade operation. The term "hydrodewaxed feedstock", when used herein, shall refer either to the total dewaxed effluent or to the effluent from which some or all of the light products have been separated, since such separation is optional and not considered a part of this invention.

The hydrocracking catalyst useful in the broadest aspect of this invention comprises a cracking catalyst and a hydrogenation component. The cracking component is a conventional large-pore cracking catalyst such as silica-alumina, silica-titania, silica-zirconia, silica-boria, clay, or a large pore aluminosilicate of the X or Y type or any mixtures thereof. These materials, as is generally known in the art, have pore sizes such that they will allow entry of essentially all the components present in a lube stock.

The amount of the hydrogenation/dehydrogenation component employed is not narrowly critical and can range from about 0.01 to about 30 weight percent based on the entire catalyst. A variety of hydrogenation components may be combined with of the cracking component in any feasible manner which affords intimate contact of the components, employing well known techniques such as impregnation, coprecipitation, cogellation, mechanical admixture of one component with the other exchange and the like. The hydrogenation component can include metals, oxides, and sulfides of metals of the Periodic Table which fall in Group VIB including chromium, molybdenum, tungsten, and the like; Group IIB including zinc cadmium; and Group VIII including cobalt, nickel, platinum, palladium, rhenium, rhodium and the like and combinations of metals, sulfides and oxides of metals of Group VIB and VIII, such as nickel-tungsten-sulfide, cobalt oxide-molybdenum oxide and the like.

The particularly advantageous embodiment of this invention resides in the use of the hydroprocessing catalyst briefly described above. The nature of this catalyst will now be given in greater detail.

When a platinum group metal hydrogenation component such as palladium is incorporated with the crystalline molecular sieve zeolites ZSM-20 or dealuminized Y (both $SiO_2/Al_2O_3 > 6$), a catalyst is produced which has the ability to (1) hydrogenate aromatic hydrocarbons at low pressure in the presence of sulfur and nitrogen poisons;

(2) convert sulfur and nitrogen containing poisons to $X_2S$ and $NH_3$ and saturated hydrocarbons;

(3) hydroconvert hydrocarbon mixtures containing sulfur and nitrogen poisons in part to lower molecular weight mixtures while substantially improving the quality of the material remaining in the original boiling range of the remaining mixture.

It is known that palladium and other Group VIII metals deposited on amorphous supports are unable to hydrogenate aromatic hydrocarbons at low pressure in the presence of sulfur and nitrogen poisons. In addition, it is known (A. V. Agafonov et al, Khimiya i Tekhnologiya Topliv i Masel, No. 6 pp. 12–14, June, 1976) that Pd deposited on NaX, NaY, mordenite, KnaL, and KNa Erionite are also essentially inactive for the above-mentioned conversion. We have also shown that the same applies to Pd/HZSM-12 and Rh H B. The only Pd zeolite known to us to possess high activity for the above-mentioned conversion are Pd Dealuminized Y (s. Agafonov et al, above) and the Pd/ZSM-20 catalyst we have prepared.

Both Dealuminized Y and ZSM-20 are, as mentioned above, materials described in U.S. Pat. Nos. 3,442,795 and 3,972,983, respectively, which description is herein incorporated by reference. In addition, catalysts that contain these zeolites as the principal or only active zeolitic component are active and stable in hydrocracking at pressures of 500—1500 psi and 500°–700° F., whereas it is not uncommon for such hydrocracking processes to operate at 2000–3000 psi and 650°–800° F.

For purposes of this invention, the original cations of the as synthesized ZSM-20 are replaced in accordance with techniques well known in the art, at least in part, by ion exchange with other cations. Preferred replacing cations include metal ions, ammonium ions, hydrogen ions and mixtures thereof. Particularly preferred cations are those which render the zeolite catalytically-active, especially for hydrocarbon conversion. These include hydrogen, hydrogen precursors (e.g. ammonium ions), rare earth metals, aluminum, metals of Groups IB, IIB, IIIB, IVB, VIB, IIA, IIIA, IVA and VIII of the Periodic Table of Elements.

The hydrocracking or hydroconversion catalyst for the present invention may be formed in a wide variety of particle sizes. Generally speaking, the particles can be in the form of a powder, a granule, or a molded product, such as extrudate having a particle size sufficient to pass through a 2 mesh (Tyler) screen and be retained on a 400 mesh (Tyler) screen. In cases where the catalyst is molded, such as by extrusion, the aluminosilicate can be extruded before drying or partially dried and then extruded. A calcination step often is useful to burn off organic contaminants and/or to stabilize the catalyst.

As in the case of many catalysts, it may be desired to incorporate the zeolite with another material resistant to the temperatures and other conditions employed in the hydrocracking or hydroconversion process. Such matrix materials include active and inactive materials and synthetic or naturally occurring zeolites as well as inorganic materials such as clays, silica and/or metal oxides, such as alumina. The latter may be either naturally occurring or in the form of gelatinous precipitates, sols or gels including mixtures of silica and metal oxides. Use of a material in conjunction with the zeolite, i.e. combined therewith, which is active, tends to improve the conversion and/or selectivity of the catalyst in certain organic conversion processes. Inactive materials suitably serve as diluents to control the amount of conversion in a given process so that products can be obtained economically without employing other means for controlling the rate of reaction. Frequently, zeolite materials have been incorporated into naturally occurring clays, e.g. bentonite and kaolin. These materials, i.e. clays, oxides, etc., function, in part, as binders for the catalyst. It is desirable to provide a catalyst having good crush strength, because in a petroleum refinery the catalyst is often subjected to rough handling, which tends to break the catalyst down into powder-like materials which cause problems in processing.

Naturally occurring clays which can be composited with the synthetic zeolite catalysts include the montmorillonite and kaolin family, which families include the sub-bentonites, and the kaolins commonly known as Dixie, McNamee, Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the present catalyst can be composited with a porous matrix material such as silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-zirconia. The matrix can be in the form of a cogel. A mixture of these components could also be used. The relative proportions of finely divided crystalline zeolite, e.g. ZSM-20, and inorganic oxide gel matrix vary widely with the crystalline aluminosilicate content ranging from about 1 to about 90 percent by weight and more usually in the range of about 2 to about 70 percent by weight of the composite.

For purposes of the present invention, the dewaxed feedstock and hydrogen are contacted with the hydrocracking or the hydroconversion catalyst described above utilizing any conventional method of contact such as trickle bed and fluidized bed. Table II summarizes the contacting conditions assuming that a stationary fixed bed of catalyst is employed. Equivalent conditions apply when other modes of contacting are used.

TABLE II

| HYDROCRACKING OR HYDROCONVERSION CONDITIONS | | | | |
|---|---|---|---|---|
| Conditions | LHSV | Temperature | Pressure | $H_2$ Circulation |
| Broad | 0.1–10 $hr^{-1}$ | 400°–1000° F. (204°–537° C.) | 500–3500 psig | 1000–20,000 SCF/bbl |
| Preferred | 0.5–2 $hr^{-1}$ | 550°–750° F. (288°–399° C.) | 750–2000 psig | 5000–10,000 SCF/bbl |

The described embodiments of the present invention are concerned essentially with the sequence comprising catalytic dewaxing followed by hydrocracking (or hydroconversion). Although the described hydroconversion catalyst is outstanding in its resistance to sulfur and nitrogen poisons, its activity is reduced by the presence of high levels of organic nitrogen in the dewaxed feedstock. Likewise, conventional hydrocracking catalysts are even more affected by nitrogen in the feed. In general, when the dewaxed feedstock contains high levels of deleterious nitrogen compounds, the preferred embodiment of this invention includes a hydrotreating step interposed between the dewaxing and the hydrocracking steps to reduce the nitrogen level of the dewaxed feedstock to less than about 200 ppm calculated as $NH_3$. Any conventional hydrotreating catalyst and process may be used which serve effectively to reduce the nitrogen and sulfur levels. The hydrotreating catalyst comprises a hydrogenation component on a non-acidic support, such as cobalt-molybdate or nickel-molybdate on alumina. The hydrotreater operates at 425°-750° F. (218°-399° C.), preferably 475°-700° F. (246°-371° C.), and space velocity like that of the catalyst dewaxing reactor. The reactions are carried out at hydrogen partial pressures of 150-1500 psia, at the reactor inlets, and preferably at 750-1250 psia, with 1000 to 10,000 standard cubic feet of hydrogen per barrel of feed (SCF/B), preferably 2500 to 5000 SCF/B.

As is evident to one skilled in the art, the steps of catalytic dewaxing, hydroconversion, and of hydrotreating when the latter is included, may be conducted without interstage separation of light products, i.e. in cascade fashion. The conditions for the individual process steps may be coupled, e.g. substantially the same pressure may be used in all three steps, or each step may be independently optimized. All of these modes of operation are contemplated as within the scope of the present invention, the choice in each particular instance depending on the nature of the feed and the desired results including by-product type and composition. Uncoupled operation does, of course, provide the most flexible operation. In all cases, however, the product formed in the hydroconversion step will require separation and recovery of the +650° F. (+343° C.) lube base stock from light products. Such separation is accomplished by methods well-known to those skilled in the art.

The following example illustrates one mode of operation of the process of this invention and it is given here only to illustrate the invention.

EXAMPLE

A 650°-850° F. Arabian Light Vacuum gas oil cut was used as feed. Properties of the feedstock were as shown in Table III.

TABLE III

| | | |
|---|---|---|
| Gravity (°API) | | 23.6 |
| Gravity (Specific @ 60° F.) | | 0.9123 |
| Pour Point (°F.) | | 75 |
| Flash Point (°F. C.O.C.) | | 460 |
| Carbon (Wt %) | | 85.21 |
| Hydrogen (Wt %) | | 12.06 |
| Sulfur (Wt %) | | 2.67 |
| Nitrogen (PPM) | | 540 |
| DISTILLATION | (D1160) °F. | |
| IBP | 676 | |
| 5 | 732 | |
| 10 | 747 | |
| 20 | 761 | |
| 30 | 772 | |
| 40 | 782 | |
| 50 | 794 | |
| 60 | 803 | |
| 70 | 817 | |
| 80 | 831 | |
| 90 | 845 | |
| 95 | 853 | |

The feedstock and hydrogen were passed in cascade fashion through two reactors. The first reactor contained 10 cc (5.68 gm) 20-30 mesh steamed* NiZSM-5 diluted with 10 cc (11.59 gm) 20-30 mesh vycor. Preheat and exit sections of the reactor were filled with 14—30 mesh vycor. The second reactor contained two 10 cc undiluted catalyst beds separated by 14-30 mesh vycor. The top bed contained 10 cc (7.95 gm) Harshaw HT 500 ($NiMo/Al_2O_3$) 1/32" exrudate. The bottom bed contained 10 cc (5.85 gm) 20-30 mesh 5% PdMg Dealuminized Y. The catalyst train was dried in flowing nitrogen at 150° C. for 2.5 hours and then reduced and presulfided in flowing 2.1% $H_2S$ in $H_2$ at atmospheric pressure and 400° C. overnight. Start of cycle conditions were 0.35 LHSV, overall 1500 PSI, 5000 SCF/$H_2$/BBL and reactor temperatures of Ni ZSM-5: 550° F.

$NiMo/Al_2O_3$: 650° F.

PdMgDeAL Y: 600° F.

*12 hours, 50/50 $H_2O/H_2$, 800° F.

Start of cycle conditions for the steamed Ni ZSM-5 which was the first of the three catalysts in cascade were 1500 PSI, 1.05 LHSV, 5000 SCF $H_2$/BBL and 550° F. Temperature of this reactor was raised at a rate sufficient to maintain the pour point of the 750° F.+ product from the Pd Y hydrocracking stage at +5° F. Based on the results obtained we estimate initial aging rate to be approximately 10° F./day. After 26 days on stream temperature had been increased to 675° F. and was held constant for the remainder of the run. During this period, an interstage sample of the product from the dewaxing stage, taken at 28 days on stream had a pour point of −25° F. while the 750° F.+ product from the Pd Y hydrocracking stage at the same time on stream had a pour point of +10° F.

The hydrotreating stage was operated at constant conditions of 700° F. and 1.05 LHSV. Other conditions used in the study were 1500 PSI pressure, and a hydrogen circulation rate of 10,000 SCF/BBL. At these conditions the $NiMo/Al_2O_3$ treated product contained 110 ppm of nitrogen, representing 82 wt.% removal.

The hydroconversion catalyst was operated at 1.05 LHSV, 1500 PSI, and a hydrogen circulation rate of 5000 SCF/BBL. The catalyst was found to be very stable over a 42-day period of observation.

Over a 41 day period, after the first three days on stream, the +750° F. product sampled from the hydroprocessing stage had a pour point not exceeding +10° F. (−12° C.), and a V.I. of at least 90 except for one sample with a V.I. of 87. Most of the samples fell within the V.I. range of 95 to 105. Yields ranged from about 25 to about 50 wt.% of the hydrocarbon feed. The products were all well hydrogenated.

The foregoing description and example show that the process of the present invention retains the advantages associated with lube hydrocracking such as the ability to produce high V.I. base stocks from low quality gas oils, with the production of reformable naphtha and low pour diesel fuel as byproducts instead of furfural extract and wax. Unlike conventional lube hydrocracking, however, the process of the present invention may be operated at pressures of about 1500 psig, which offers significant added economic advantage.

What is claimed is:

1. A method for catalytically converting a hydrocarbon oil feedstock boiling above 650° F. (343° C.) and selected from the group consisting of vacuum gas oils, deasphalted oils, and mixtures thereof, to low-pour, high V.I. lube basestock, which method comprises contacting said feedstock and hydrogen with a dewaxing catalyst comprising a zeolite having a Constaint Index of 1 to 12, said contacting conditions being effective to reduce the pour point of the +650° F. (+343° C.) fraction of said feedstock to less than about +15° F. (−9° C.); contacting said dewaxed feedstock and hydrogen with a hydroconversion catalyst comprising a platinum group metal and a zeolite having a silica to alumina ratio of at least 6, said zeolite being selected from the group consisting of Dealuminized Y and ZSM-20, said contacting with said hydroconversion catalyst being at a temperature of 400°–1000° F. (204°–537° C.), a pressure of 500–3500 psig, and at a space velocity of 0.1 to 10 L.H.S.V.; and recovering said lube oil base stock having a pour point not higher than about 25° F.

2. The method described in claim 1 wherein said zeolite having a Constraint Index of 1 to 12 is selected from the group consisting of ZSM-5 and ZSM-11.

3. The method described in claim 1 wherein said contacting with said hydroconversion catalyst is conducted at a pressure of 750 to about 2000 psig.

4. The method described in claim 2 wherein said contacting with said hydroconversion catalyst is conducted at a pressure of 750 to about 2000 psig.

5. The method described in claim 2 wherein said hydroconversion catalyst is ZSM-20.

6. The method described in claim 3 wherein said hydroconversion catalyst is ZSM-20.

7. The method described in claim 4 wherein said hydroconversion catalyst is ZSM-20.

8. The method described in claim 1 or 2 or 3 or 4 or 5 or 6 or 7 wherein said feedstock is a vacuum gas oil.

9. The method described in claim 1 or 2 or 3 or 4 or 5 or 6 or 7 wherein said platinum group metal is palladium.

10. The method described in claim 1 wherein is included the step of hydrotreating said dewaxed feedstock whereby its organic nitrogen content is reduced to less than about 200 ppm.

11. The method described in claim 2 wherein is included the step of hydrotreating said dewaxed feedstock whereby its organic nitrogen content is reduced to less than about 200 ppm.

12. The method described in claim 3 wherein is included the step of hydrotreating said dewaxed feedstock whereby its organic nitrogen content is reduced to less than about 200 ppm.

13. The method described in claim 4 wherein is included the step of hydrotreating said dewaxed feedstock whereby its organic nitrogen content is reduced to less than about 200 ppm.

14. The method described in claim 5 wherein is included the step of hydrotreating said dewaxed feedstock whereby its organic nitrogen content is reduced to less than about 200 ppm.

15. The method described in claim 6 wherein is included the step of hydrotreating said dewaxed feedstock whereby its organic nitrogen content is reduced to less than about 200 ppm.

16. The method described in claim 7 wherein is included the step of hydrotreating said dewaxed feedstock whereby its organic nitrogen content is reduced to less than about 200 ppm.

17. The method described in claim 10 or 11 or 12 or 13 or 14 or 15 or 16 wherein said feedstock is a vacuum gas oil.

18. The method described in claim 10 or 11 or 12 or 13 or 14 or 15 or 16 wherein said platinum group metal is palladium.

19. In a process for catalytically converting a waxy hydrocarbon oil boiling above 650° F. (343° C.) and substantially free of asphalt to a high V.I low pour point lube base stock, which process comprises catalytically dewaxing said oil, the improvement whereby an increased yield of said high V.I. low pour point lube base stock is obtained, which comprises, in combination:

contacting said waxy hydrocarbon oil and hydrogen in a first reaction zone with a zeolite catalyst having a Constraint Index of 1 to 12 and a silica to alumina ratio above 12, said contacting being at a temperature of 400°–1000° F. (204°–537° C.), a pressure of 500–3500 psig, and a L.H.S.V. of 0.1–10 $hr^{-1}$, thereby dewaxing said oil;

contacting said dewaxed oil and hydrogen in a second reaction zone with a large pore hydrocracking or a hydroconversion catalyst under conditions effective to increase the V.I. of the lube oil fraction of said dewaxed oil; and recovering said high V.I. low pour point lube base stock.

20. The process described in claim 19 wherein said zeolite catalyst having a Constraint Index of 1 to 12 is ZSM-5 or ZSM-11, and said contacting temperature is 450°–850° F. (232°–454° C.).

21. The process described in claim 20 wherein a hydroconversion catalyst is used, said catalyst comprising a platinum group metal and a zeolite having a silica to alumina ratio of at least six, said zeolite being selected from the group consisting of dealuminized Y and ZSM-20, and wherein contacting with said hydroconversion catalyst is conducted at a pressure of 750 to about 2000 psig.

22. The process described in claim 19 or 20 or 21 wherein said dewaxed oil from said first reaction zone is hydrotreated to reduce its nitrogen content to less than about 200 ppm prior to contact with said hydrocracking or hydroconversion catalyst.

* * * * *